United States Patent [19]

Uchida

[11] Patent Number: 4,744,771

[45] Date of Patent: May 17, 1988

[54] FIXING STRUCTURE OF CONTACT TAILS OF ELECTRICAL CONNECTOR

[75] Inventor: Kanzaburo Uchida, Mooka, Japan

[73] Assignee: Daiichi, Denshi, Kogyo, Kabushika, Kaisha, Tokyo, Japan

[21] Appl. No.: 43,027

[22] Filed: Apr. 27, 1987

[30] Foreign Application Priority Data

Apr. 30, 1986 [JP] Japan ..... 61-65887[U]

[51] Int. Cl.[4] ..... H01R 13/64; H01R 13/42

[52] U.S. Cl. ..... 439/374; 439/733

[58] Field of Search ..... 439/62, 78, 544, 545, 439/552, 553, 554, 562, 571, 572, 574, 733, 629, 630, 631, 632, 633, 634, 635, 636, 637, 374, 869

[56] References Cited

U.S. PATENT DOCUMENTS

| | | | |
|---|---|---|---|
| 3,112,145 | 11/1963 | Swengel | 439/55 |
| 3,142,000 | 7/1964 | Bernstein | 439/78 |
| 3,531,581 | 9/1970 | Chesemore | 439/78 |
| 3,555,493 | 1/1971 | Baumanis | 439/636 |
| 3,744,005 | 7/1973 | Sitzler | 439/637 |
| 4,550,962 | 11/1985 | Czeschka | 439/78 |
| 4,568,136 | 2/1986 | Reuss | 439/629 |

FOREIGN PATENT DOCUMENTS 0103949 3/1984 European Pat. Off. .

2248665 5/1975 France .

*Primary Examiner*—Gil Weidenfeld
*Assistant Examiner*—Gary F. Paumen
*Attorney, Agent, or Firm*—Silverman, Cass, Singer & Winburn, Ltd.

[57] ABSTRACT

A structure for fixing contact tails of contact of a connector. The contact tails are aligned in rows and provided with holding projections to be press-fitted in fixing slits formed in a locator plate of the electrical connector. The slits are in parallel with each other with an interval equal to that of the contact tails in one row and extending at right angles to an aligned direction of the contact tails in the one row. The holding projections of the contact tails are formed larger as the contact tails located in the fixing slits are nearer to entrances of the slits. Each the fixing slit is formed in a T-shaped configuration in cross-section comprising a common locating slit portion for receiving parts of the contact tails having no holding projections and press-fixing slit portion for press-fitting the holding projections of the contact tails therein. The press-fixing slit portion comprises a plurality of slit portion sections formed progressively larger in stepwise manner as they are nearer to an entrance of the slit. The structure is capable of securely holding the contact tails even if external forces act on them in use or during transportation.

3 Claims, 4 Drawing Sheets

FIXING STRUCTURE OF CONTACT TAILS OF ELECTRICAL CONNECTOR

BACKGROUND OF THE INVENTION

This invention relates to a fixing structure of contact tails of an electrical connector having contacts in rows.

In the case of connecting a printed circuit to an external circuit, for example, a following method is usually employed. As shown in the exploded perspective view of FIG. 1*a* and the assembled view of FIG. 1*b*, a receptacle connector 2 is used, whose contact tails 1A and 1B are bent at right angles to directions into which a mating connector 5 is inserted into the receptacle connector 2. In this case, such L-shaped contact tails 1A and 1B are inserted into connecting apertures 3*a* of a printed circuit board 3. Thereafter, as shown in FIG. 1*b*, the connector 2 is fixed to the printed circuit board 3 by means of set screws 4 and further the contact tails are soldered to connecting conductive portions (not shown). When the mating plug connector 5 is inserted into the receptacle connector 2, the printed circuit board is connected to the external circuit.

In inserting the contact tails 1A and 1B into the connecting apertures 3*a* of the printed circuit board 3, automatic machines are often used on a large scale. For this purpose, the contact tails must be aligned with each other with a predetermined pitch and arranged in two rows spaced apart by a predetermined distance. If this condition is not fulfilled and contact tails 1A and 1B are not inserted into the connecting apertures 3*a*, such connectors are determined to be of inferior quality and automatically rejected.

In order to avoid this, a following method is generally carried out. As shown in a partial perspective view of FIG. 2*a*, a locater plate 6 (refer to again FIG. 1) is provided integrally with the connector at its connector extending portion and formed with press-fitting slits 6*a* of the same number as that of the contact tails in the one row and with the same pitch as that of the contact tails. The press-fitting slits 6*a* have lengths capable of receiving the contact tails and extend in transverse directions to the rows of the contact tails or longitudinal directions of the connector. On the other hand, the contact tails 1A and 1B are formed on both sides with holding projections 1*a* and 1*b* having the same extending distances in order to make a width of each contact tail at the projections somewhat larger than that of the press-fitting slit 6*a*. As shown in a partial perspective assembled view of FIG. 2*b* and a partial sectional view of FIG. 2*c*, the holding projections 1*a* and 1*b* of the contact tails 1A and 1B are press-fitted into the press-fitting slits 6*a* to fix the contact tails in the slits 6*a*, thereby preventing the contact tails 1A and 1B from being moved in the slits 6*a* due to external forces acting upon the contact tails 1A and 1B during transportation of the contacts.

With this fixing structure of the prior art, however, in most cases the contact tails 1B located near entrances of the slits tend to be subject to misalignment owing to external forces acting thereupon during transportation so that a predetermined distance between the rows of the contact tails is not maintained. It results in a number of connectors inferior in quality, which should be rejected.

SUMMARY OF THE INVENTION

It is a principal object of the invention to provide an improved fixing structure for contact tails of an electrical connector, which eliminates the disadvantage of the prior art and is capable of securely holding the contact tails even if external forces act on them in use or during transportation.

In order to achieve this object, in a fixing structure for contact tails of an electrical structure, said contact tails being aligned in rows and provided with holding projections to be press-fitted in fixing slits formed in a locator plate of said electrical connector, said slits being in parallel with each other with an interval equal to that of said contact tails in one row and extending at right angles to an aligned direction of the contact tails in the one row, according to the invention, said holding projections of said contact tails are formed larger as the contact tails located in the fixing slits are nearer to entrances of the slits, and each said fixing slit is formed in a T-shaped configuration in cross-section including a common locating slit portion for receiving parts of said contact tails having no holding projections and a press-fixing slit portion for press-fitting said holding projections of the contact tails therein, said press-fixing slit portion including a plurality of slit portion sections formed progressively larger in stepwise manner as they are located nearer to an entrance of the slit.

In an embodiment of the invention, each fixing slit includes a further common locating slit portion on a side of the press-fixing slit portion opposite to the common locating slit portion to close off the press-fixing slit portion.

The invention will be more fully understood by referring to the following detailed specification and claims taken in connection with the appended drawings.

BRIEF DESCRIPTION OF THE DRAWINGS

FIG. 4*b* is a partial plan view illustrating the embodiment shown in FIG. 4*a.

DESCRIPTION OF THE PREFERRED EMBODIMENTS

Figure 1A:
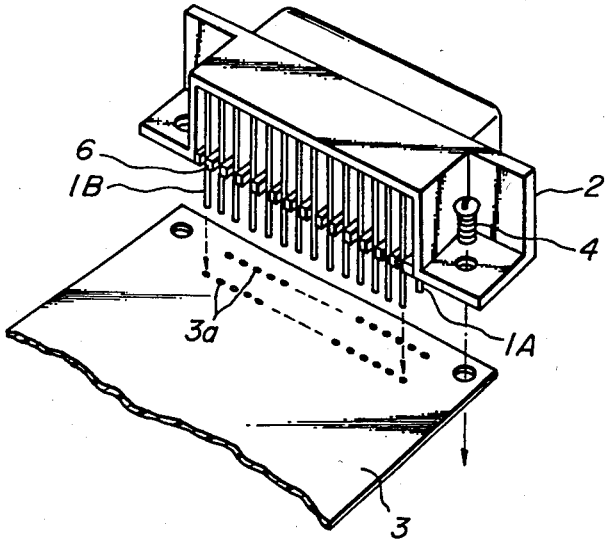
FIG 1a PRIOR ART
FIG. 1*a* is a perspective view illustrating a connector of the prior art for explaining connection of a printed circuit to an external circuit.
Figure 1B:
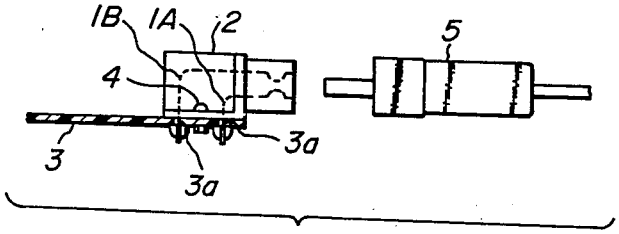
FIG 1b PRIOR ART
FIG. 1*b* is an assembled view of the connector shown in FIG. 1*a;*
Figure 2A:
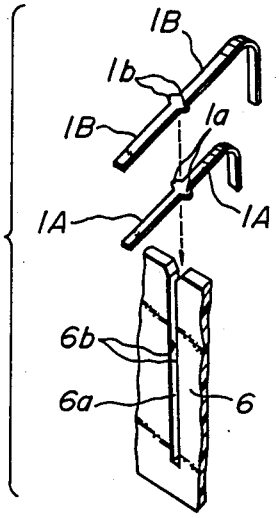
FIG 2a PRIOR ART
FIG. 2*a* is an exploded perspective view illustrating one example of fixation of contact tails of the prior art.
Figure 2B:
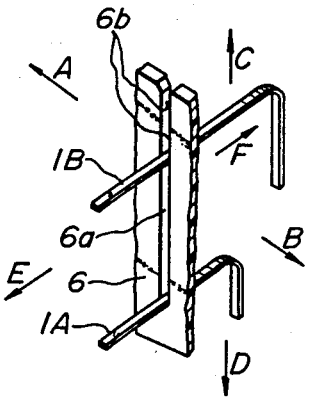
FIG 2b PRIOR ART
FIG. 2*b* is a perspective view illustrating the fixed condition of the contact tails shown in FIG. 2*a;*
Figure 2C:
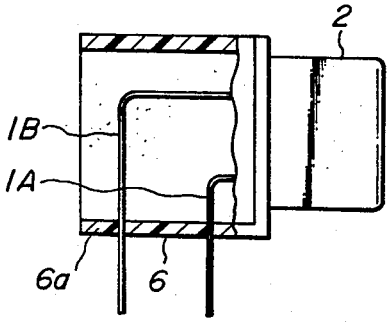
FIG 2c PRIOR ART
FIG. 2*c* is a sectional view of part of a connector having the contact tails shown in FIG. 2*a;*
Figure 3A:
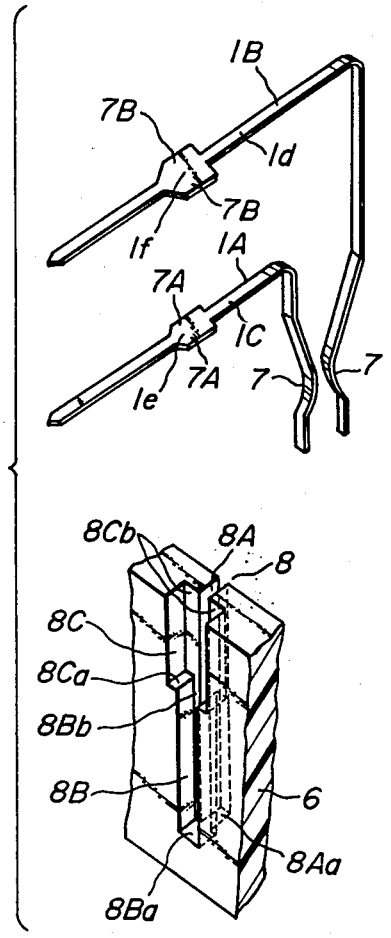
FIG. 3*a* is an exploded perspective view illustrating one embodiment of the invention.
Figure 3B:
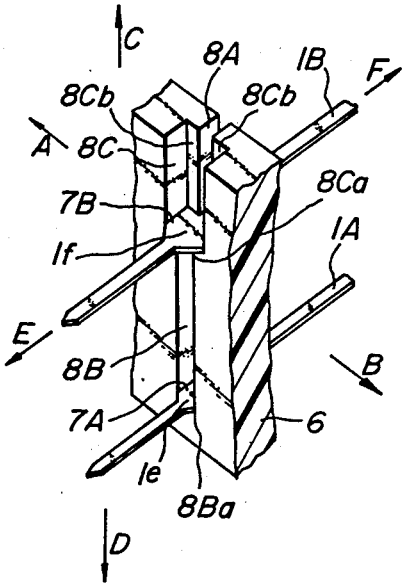
FIG. 3*b* is a perspective partially assembled view illustrating the embodiment shown in FIG. 3*a;*
Figure 4A:
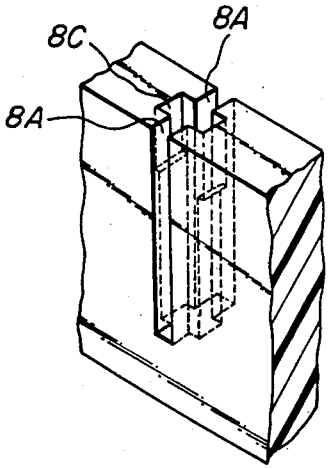
FIG. 4*a* is a partial perspective view illustrating another embodiment of the invention.
Figure 4B:
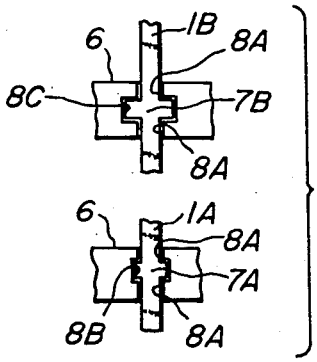

Referring back to FIG. 2*b*, the contact tail 1A located at bottoms of the slits 6*a* is hardly moved by external forces, while the contact tail 1B located near the entrance of the slit 6*a* is likely to be moved by an external force. The inventor investigated the reason why the contact tail 1B near the entrance of the slit 6*a* is generally likely to be moved and found that it is caused by the following reason. After one contact tail 1A has been press-fitted in the slit 6*a*, the other contact tail 1B is press-fitted in the same slit *6a*. Therefore, the contact tail 1B is press-fitted into the slit *6a* whose side walls *6b* have been scraped by the holding projections *1a* of the contact tail 1A to widen the slit *6a*. Accordingly, the holding faculty of the slit *6a* for the contact tail 1B near the entrance of the slit is much inferior to that for the contact tail 1A at the bottom of the slit, and the contact tail 1B near the entrance is easily moved to disturb the distance between the two rows of the contact tails 1A and 1B even by a force which could not move the contact tail 1A at the bottom of the slit.

This invention resides in the above discovery and is characterized in the following features. According to the invention, as shown in the exploded perspective view of FIG. *3a* illustrating one embodiment of the invention, a contact tail 1A to be located at a bottom of a press-fitting slit is provided on both sides of a held portion of the contact tail 1A with holding projections 7A in the form of a trapezoid extending substantially perpendicular to a direction in which a contact element 7 extends. Moreover, a contact tail 1B near an entrance of the press-fitting slit is provided on both sides of a held portion of the contact tail 1B with holding projections 7B extending longer than the holding projections 7A and substantially perpendicular to a direction in which a contact element 7 extends.

A locator plate 6 is provided with a plurality of T-shaped slits 8, each slit extending into the plate 6 a distance which accommodates at least two rows of contact tails. Each fixing slit 8 includes a common locating slit portion 8A in which portions *1c* and *1d* of the contact tails 1A and 1B, other than the holding projections 7A and 7B, are snugly fitted without play. Press-fixing slit portion sections 8B and 8C communicate in a common center line with the common locating slit portion 8A, respectively. The press-fixing slit portion section 8B has a bottom 8Ba flush with a bottom 8Aa of the common locating slit portion 8A for supporting a holding projection portion *1e* of the contact tail 1A. The press-fixing slit portion section 8C has a bottom 8Ca located above the bottom 8Ba of the press-fixing slit portion section 8B by a predetermined distance for supporting a holding projection portion *1f* of the contact tail 1B. Accordingly, the press-fixing slit portion includes a plurality of slit portion sections formed larger in stepwise manner as they are closer to an entrance of the slit. With respect to the common locating slit portion 8A, the press-fixing slit portion sections 8B and 8C are positioned on that side of the locator plate 6 into which the contact tails 1A and 1B extend, or the left side as viewed in FIG. *3a*.

As shown in the perspective assembled view of FIG. *3b*, the contact tail 1A is inserted into the common locating slit portion 8A, while the holding projections *7a* are press-fitted into the press-fixing slit portion sections 8B until the holding projection portion *1e* abuts against the bottom 8Ba. Then, the contact tail 1B is likewise inserted into the press-fixing slit portion section 8C until the holding projection portion *1f* of the holding projections 7B abuts against the bottom 8Ca. In this manner, the contact tails 1A and 1B are fixed to the locator plate 6 such that the contact tails are aligned with each other with a predetermined interval in respective rows which are spaced apart from each other by a predetermined distance.

As can be seen from the above explanation, the holding projection portions *1e* and *1f* of the holding projections *7a* and 7B of the contact tails 1A and 1B are press-fitted and fixed in the quite separate press-fixing slit portion sections 8B and 8C. Accordingly, there is no risk of walls of the fixing slit being scraped to widen the slit by the holding projections of a contact tail as in the prior art wherein two contact tails are press-fitted into the same slit.

With the structure of the prior art, as shown in FIG. *2b*, the contact tail 1B close to the entrance of the slit *6a* is completely prevented from moving in directions shown by arrows A and B by both the walls *6b* of the slit *6a*. However, movement of the contact tail 1B in directions shown by arrows C, D, E and F is prevented only by the holding force caused by the press-fitting of the holding projections *1b* in the slit. Such an unreliable holding faculty often unintentionally permits the contact tail to move in the slit. In contrast herewith according to the invention, as shown in FIG. *3b*, movement of the contact tail 1B near the entrance of the slit in directions shown by arrows A and B is of course completely prevented, and the bottom 8Ca of the press-fixing slit portion 8C completely prevents a movement of the contact tail 1B in a direction shown by an arrow D. The holding projections 7B abutting against side walls 8Cb completely prevent a movement of the contact tail 1B in a direction shown by an arrow F. The contact tail 1B is therefore securely held and fixed in conjunction with the improved holding force by press-fitting in a more reliable manner than in the prior art.

With the structure of the prior art, moreover, the contact tail 1A at the bottom of the slit is completely prevented from moving in directions shown by the arrows A, B and D shown in FIG. *2b* by the side walls and the bottom of the slit *6a*. However, a movement of the contact tail 1A in the direction shown by the arrow F is prevented only by the holding force caused by the press-fitting of the holding projections *1a* in the slit. In contrast herewith, according to the invention as shown in FIG. *3b*, the movement of the contact tail 1A in the direction shown by the arrow F is completely prevented by side walls 8Bb of the press-fixing groove 8B (FIG. *3a*) without relying upon the holding force caused by the press-fitting of the holding projections. The holding force for the contact tails can be considerably improved in comparison with that in the prior art. Moreover, according to the invention the contact tail near the entrance of the slit and the contact tail at the bottom of the slit can be held and fixed by substantially equal holding forces.

If it is desired to completely prevent the movement of contact tails in the direction E or movement caused by tensile forces acting upon the contact tails it can be accomplished by features shown in FIGS. *4a* and *4b*. Referring to the perspective view of FIG. *4a*, in addition to a T-shaped fixing slit 8 consisting of a common locating slit portion 8A and press-fixing slit portion sections 8B and 8C, there is provided a further common locating slit portion 8A to close off the press-fixing slit portion sections 8B and 8C, thereby preventing the holding projections 7A and 7B from being moved as shown in the plan view of FIG. *4b*. In an actual case, however, as the contact tails are rarely subjected to a force in the extending direction of the contact tail or the direction E, it is seldom required to provide the further common locating slit portion 8A. Even if such a force acts on the contact tail, the holding force caused by the press fitting of the holding projections suffices to resist such a force in many cases.

Figure 5:
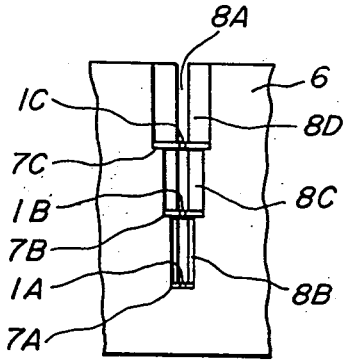
* and FIG. 5 is a front elevation illustrating a further embodiment of the invention.

Although the two rows of the contact tails have been shown in the above embodiments, the invention is of course applicable to a connector having more rows, for example, three rows of contact tails. As shown in a front elevation of FIG. 5, in this case, press-fixing slit portion sections 8B, 8C and 8D are formed in a locator plate, 80 being closest to an entrance of the slit. On the other hand, holding projections 7A, 7B and 7C of contact tails 1A, 1B and 1C are formed larger as the contact tails located in the slit are closer to the entrance of the slit. Moreover, this invention may of course be applicable to contact tails other than the L-shaped contact tails.

While the invention has been particularly shown and described with reference to preferred embodiments thereof, it will be understood by those skilled in the art that the foregoing and other changes in form and details can be made therein without departing from the spirit and scope of the invention.

What is claimed is:

1. A fixing structure for contact tails of an electrical connector, said contact tails being aligned in rows and provided with holding projections to be press-fitted in a plurality of fixing slits formed in a locator plate of said electrical connector, said slits being in parallel with each other and having an interval equal to the spacing of said contact tails in one of said rows, said slits extending at right angles to said rows, said fixing structure comprising:

a first holding projection for a first said contact tail of one of said rows to be located at a bottom of one of said fixing slits and in the form of a first trapezoid extending perpendicularly to and on both sides of said contact tail;

a second holding projection of a second said contact tail in a second of said rows located closer to an entrance of said one fixing slit than said first holding projection is provided with a second trapezoid wider than said first trapezoid, said second holding projection extending perpendicularly to and on both sides of said second contact tail;

said one firing slit is formed in a T-shaped configuration in cross-section including a common locating slit portion for receiving parts of said first and second contact tails having no holding projections and a press-fixing slit portion for press-fitting said holding projections of said first and second contact tails therein, said press-fixing slit portion including a plurality of slit portion sections formed progressively larger in stepwise manner as they are closer to an entrance of said one slit, said slit portion sections having widths able to receive said holding projections of said contact tails by press-fitting and said holding projections being pushed and fixed to bottoms of said slit portion sections.

2. A fixing structure for contact tails of an electrical connector as set forth in claim 1, wherein said one fixing slit further comprises an additional common locating slit portion on an oppisite side of said press-fixing slit portion to close off said press-fixing slit portion.

3. A fixing structure for contact tails of an electrical connector as set forth in claim 1, wherein said plurality of slit portion sections are formed in three steps for contacting one tail in each of three rows.

* * * * *